United States Patent [19]

Pilatowicz

[11] Patent Number: 4,583,291

[45] Date of Patent: Apr. 22, 1986

[54] ELECTRIC CHAIN SAW SPEED REDUCTION DEVICE

[75] Inventor: Edward J. Pilatowicz, Los Angeles, Calif.

[73] Assignee: McCulloch Corporation, Los Angeles, Calif.

[21] Appl. No.: 616,142

[22] Filed: Jun. 1, 1984

[51] Int. Cl.[4] ..... B27B 17/02

[52] U.S. Cl. ..... 30/383

[58] Field of Search ..... 30/381–387; 474/88, 156, 174, 205, 206, 237, 242

[56] References Cited

U.S. PATENT DOCUMENTS

| | | | |
|---|---|---|---|
| 962,342 | 6/1910 | Harrell | 474/88 |
| 1,341,470 | 5/1920 | Kinnaird | 474/237 |
| 1,634,438 | 7/1927 | Spreen | 474/174 X |
| 3,634,814 | 4/1972 | Richmond | 474/156 |
| 3,738,187 | 6/1973 | Hissrich | 474/205 X |
| 3,857,179 | 12/1974 | Haupt et al. | 30/381 |
| 4,028,964 | 6/1977 | Jones | 474/88 |
| 4,324,045 | 4/1982 | Hoppner et al. | 30/381 |

*Primary Examiner*—Douglas D. Watts

*Attorney, Agent, or Firm*—Murray, Whisenhunt and Ferguson

[57] ABSTRACT

An improved speed reduction drive for an electric chain saw is disclosed. The speed reduction drive comprises a first rotatable member directly driven by the drive shaft of the electric motor for rotation therewith. A second rotatable member is connected to the drive sprocket for the cutter chain for rotation in the same direction. At least one endless drive loop drivingly connects the first and second rotatable members for rotation in the same direction, whereby rotational inertia of the electric motor opposes "kickback" of the chain saw.

8 Claims, 14 Drawing Figures

ELECTRIC CHAIN SAW SPEED REDUCTION DEVICE

BACKGROUND OF THE INVENTION

1. Field of the Invention

This invention relates to electric chain saws. More particularly, this invention relates to a speed reduction device for coupling the electric motor of an electric chain saw with the drive sprocket for the cutter chain of the saw.

2. Description of the Prior Art

Electric chain saws adapted for heavy cutting requirements require a gear drive to reduce the speed of the cutting chain while maintaining a high engine speed and maximum horsepower. For instance, a typical electric motor operating at 18,000 RPM, if directly coupled to a drive sprocket having six teeth 0.375 pitch chain, will produce a chain linear speed of 6,848 feet per minute (78 miles per hour). This would produce excessive chain "slap" and wear on the guide bar, as well as increasing the magnitude of any "kickback" of the chain saw.

Various attempts have been made to provide speed reduction systems for chain saws.

Irgens, U.S. Pat. No. 3,669,162, provides a chain saw with a gear drive. In particular, Irgens provides a compact gear drive for a chain saw which provides adequate power for heavy cutting requirements and which does not appreciably increase the weight of the chain saw. The gear drive includes a combination gear and cutting chain sprocket in the form of a ring which has, along the outer periphery thereof, a plurality of circumferentially arranged recesses which receive and drive the drive tangs of the cutting chain. In addition, the internal surface of the sprocket ring is provided with internal teeth which mesh with the teeth of a pinion gear which is fixedly connected to the drum of a centrifugal clutch and is rotatably supported on the output shaft of the engine. To minimize the size and diameter of the sprocket, the recesses are inwardly open and the pinion gear on the output shaft comprises two sets of axially spaced teeth separated by an annular groove. The drive tangs project through the sprocket ring and are received in the annular groove. The combination gear and cutting chain sprocket is supported in eccentric relation to the axis of the output shaft by a bearing in the form of a hub which is located interiorly of the combination gear and sprocket and connected to the engine crankcase. The internal teeth of the combination gear and sprocket ride on the outer bearing surface of the hub. Of course, an opening is provided in the hub whereby the teeth of the pinion gear come into engagement with the gear teeth of the combination gear and sprocket.

While Irgens provides a light and compact gear drive, the utilization of an internally toothed gear renders the gear drive susceptible to clogging. In particular, saw dust produced during cutting operations will tend to build up in the spaces between the internal gear teeth and ultimately clog the mechanism, preventing engagement with the pinion gear. This will necessitate disassembly of the saw in order to unclog the gear mechanism.

Haupt et al, U.S. Pat. No. 3,857,179, attempts to overcome this problem by shielding the gear drive from saw dust infiltration. Haupt et al notes that electric chain saws, which are provided with gear reduction between the motor and the saw chain, have the gears completely enclosed within a sealed gear housing so that saw dust, dirt and other foreign material cannot reach the gears. Haupt et al further notes that this sealing of the gear housing increases the cost of the gear reduction and also requires a separate drive sprocket for the saw chain to be mounted outside the gear housing. In order to overcome these problems, Haupt et al provide a gear reduction system between the motor and the drive sprocket which is not enclosed within a sealed housing. Rather, the gears are designed to provide their own protection against the infiltration of foreign matter. The large, driven gear is generally cup-shaped and includes a cylindrical side wall and a flat end wall. Gear teeth are provided on the inside surface of the side wall. A drive gear is mounted on the drive shaft of an electric motor and engages the gear teeth of the driven gear. The electric motor is mounted on the housing of the chain saw, and the drive shaft of the motor extends through a portion of the housing which is positioned adjacent the open end of the driven gear. Thus, the open end of the driven gear is substantially closed by a wall of the saw housing and the drive gear is positioned within the driven gear. The saw housing may further include an arcuate wall which extends around the outer periphery of the driven gear to further enclose the gears. A sprocket for the saw chain is mounted on the outside of the end wall and is drivingly engaged with the chain.

While Haupt et al provide a chain saw without a sealed gear box, the lack of a seal may still permit foreign matter to infiltrate the gear mechanism. Moreover, the internal gear teeth of the driven gear are difficult to make and, consequently, add to the cost of manufacture.

Siman, U.S. Pat. No. 4,010,544, disclose a power transmission system for a chain saw wherein a belt drive is used to connect a pulley mounted on the crankshaft of an engine to a pulley mounted on a stub shaft which drives the drive sprocket engaging the saw chain. However, this particular power transmission is only used in order to isolate engine vibration from the chain saw housing. In other words, the Siman patent is directed to chain saws powered by single cylinder fluid pressure engines. Such engines have come into wide use because of their light weight, low cost, reliablity and versatility. However, such engines have one major disadvantage, namely vibration. The vibration of such single cylinder engines is caused by: rotating inertia forces of the crank and parts that revolve with it; reciprocating inertia forces of the piston and parts that reciprocate with it; inertia torque of the reciprocating parts; inertia torque due to the pendulum motion of the connecting rod; and torque variations produced by the varying gas pressure acting on the piston. The torque produced by the pendulum motion of the connecting rod is small and is commonly neglected. The torque produced by the varying gas pressure acting on the piston can be reduced by multiple cylinder arrangements but only at higher cost, greater complexity and additional weight. Siman seeks to overcome these problems by eliminating certain vibration forces and by mounting the engine in such a manner that the remaining vibration forces are not transmitted to the housing. In particular, the rotating inertia forces are eliminated by the use of counterweights while the reciprocating forces are left unbalanced. These reciprocating forces tend to produce reciprocatory vibration of the engine in a direction axial of the engine cylinder. The engine, however, is isolated from the housing by a spring-loaded linkage system which permits movement of the engine relative to the housing in the direction of the axis of the cylinder while restraining movement in the transverse dimension. Power transmission is accomplished by the aforementioned belt drive, one pulley mounted on the crankshaft of the engine, and the other mounted on a shaft rotatably supported on the housing. Although the linkage system permits movement of the engine in the direction of the engine cylinder axis, there is no change in the center-to-center distance of the pulleys and the belt drive is unaffected by the engine movement. Alternatively, two gears can be used to transmit power, since the center-to-center distance of the crankshaft and the other shaft is maintained constant by the linkage.

Thus, it is clear that Siman is limited to the particular case of overcoming vibratory motion in the single-cylinder engine of a chain saw.

Irgens, U.S. Pat. No. 3,372,718, and Scharpf, U.S. Pat. No. 3,530,909, disclose bevel gear arrangements for driving the drive sprocket of a saw chain which merely comprise a pair of externally toothed gears.

Bross, U.S. Pat. No. 4,198,752, and Kolorz, U.S. Pat. No. 3,849,883, disclose the direct mounting of the drive sprocket on the motor shaft of a gasoline-powered chain saw.

SUMMARY OF THE INVENTION

The present invention provides a speed reduction system for an electric chain saw whereby the drive shaft and the drive sprocket are connected for rotation in the same direction and the rotational speed of the drive sprocket is reduced as compared to the rotational speed of the drive shaft. The drive shaft, and hence the motor, and the drive sprocket, and hence the saw chain, rotate in the same direction so that the motor's inertia counteracts the upward movement of the saw when a "kickback" occurs. Speed reduction is effected through an endless loop drive mechanism. A first member, rotatable about an axis is directly driven by the drive shaft of the electric motor for rotation therewith. A second member, rotatable about an axis, is connected to the drive sprocket for the saw chain for rotation therewith. At least one endless drive loop, drivingly connects the first and second members for rotation in the same direction. By varying the radii of the rotatable members, a desired speed reduction ratio can be achieved. The endless drive loop mechanism is simple to make, low cost and less sensitive to dirt, i.e. foreign matter coming into contact with the mechanism tends to be flung off the rotating mechanism.

DETAILED DESCRIPTION OF THE PREFERRED EMBODIMENTS

Figure 1:
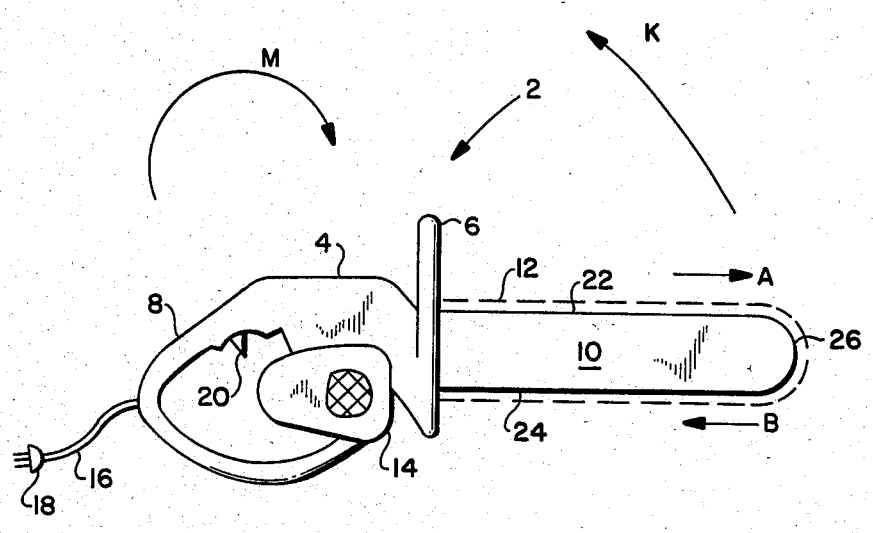
FIG. 1 is an illustration of an electric chain saw in accordance with the present invention.

Referring to FIG. 1, an electric chain saw, generally indicated at 2, according to the present invention is illustrated. The electric chain saw 2 has a housing 4 fitted with a front handle 6 and a rear handle 8. A guide bar 10 extends forwardly from the housing 4 and an endless cutter chain 12 (indicated as a dotted line) extends around the guide bar 10 and is slidingly supported thereon for rotation thereabout. A drive sprocket (not shown), rotatable about an axis, drivingly engages the cutter chain 12 to rotate the cutter chain 12 about the guide bar 10. An electric motor 14 provides the motive power to the drive sprocket through a speed reduction mechanism (not shown). The chain saw is fitted with a chain saw safety brake mechanism (not shown) which will stop rotation of the cutter chain 12 about the guide bar 10 when a "kickback" occurs. Such safety brake mechanisms are well known in the art, e.g., Baricevic, U.S. Pat. No. 4,334,357, and typically comprise a sensing arm (not shown) provided forward of the front handle 6 so that, during "kickback", the operator's hand or arm will force the sensing arm forward thereby engaging a brake with the chain saw motor 14 which will quickly bring the rotating parts of the motor to a halt. The chain saw is further fitted with a power supply cord 16 and a plug 18 for connection to an external electric power supply (not shown). A throttle switch 20 is provided on rear handle 8 for governing the speed of the electric motor 14.

During operation, the portion of the cutter chain 12 disposed on the upper edge 22 of guide bar 10 will be moving away from the housing 4 (as shown by the arrow "A"), and the portion of the cutter chain 12 disposed on the lower edge 24 will be moving toward the housing 4 (as shown by the arrow "B"). In normal operation, an object to be cut will be brought into contact with that portion of the cutter chain 12 moving along the lower edge 24 of the guide bar 10. This will desirably tend to draw the saw into the cut. However, should the portion of the cutter chain 12 disposed on the nose portion 26 or the upper edge 22 of the guide bar come into contact with the object to be cut or some other object in the area, the saw will be violently thrown back at the operator in a "kickback" wherein the saw tends to rotate in the direction shown by the arrow "K" about the center of mass of the saw (typically, the center of mass lies within the electric motor 14). In accordance with the present invention, the magnitude of this "kickback" phenomena is greatly reduced by providing a speed reduction mechanism (not shown) whereby the motor 14, i.e. the drive shaft of the motor, rotates in the same direction as the drive sprocket (not shown), i.e. the same direction as the cutter chain. In this situation, upon occurrence of the "kickback", the chain saw safety brake mechanism will rapidly bring the motor to a stop and hence the cutter chain. However, the motor has considerable rotational inertia and the rapid stoppage of the motor, brought about by the safety brake, will transfer this inertial force through the brake mechanism to the chain saw proper. This inertial force will tend to rotate the chain saw about the center of mass in the direction shown by the arrow "M". Thus, the rotational inertia of the motor "M" is harnessed to act as a counterbalance to the kickback "K". Tests have shown that by running the motor in the same rotational direction as the cutting chain, the "kickback", as measured by the degree of rotation of the saw, can be reduced by 50° of arc, as compared to the case where the motor and cutting chain rotate in opposite directions.

Figure 2:
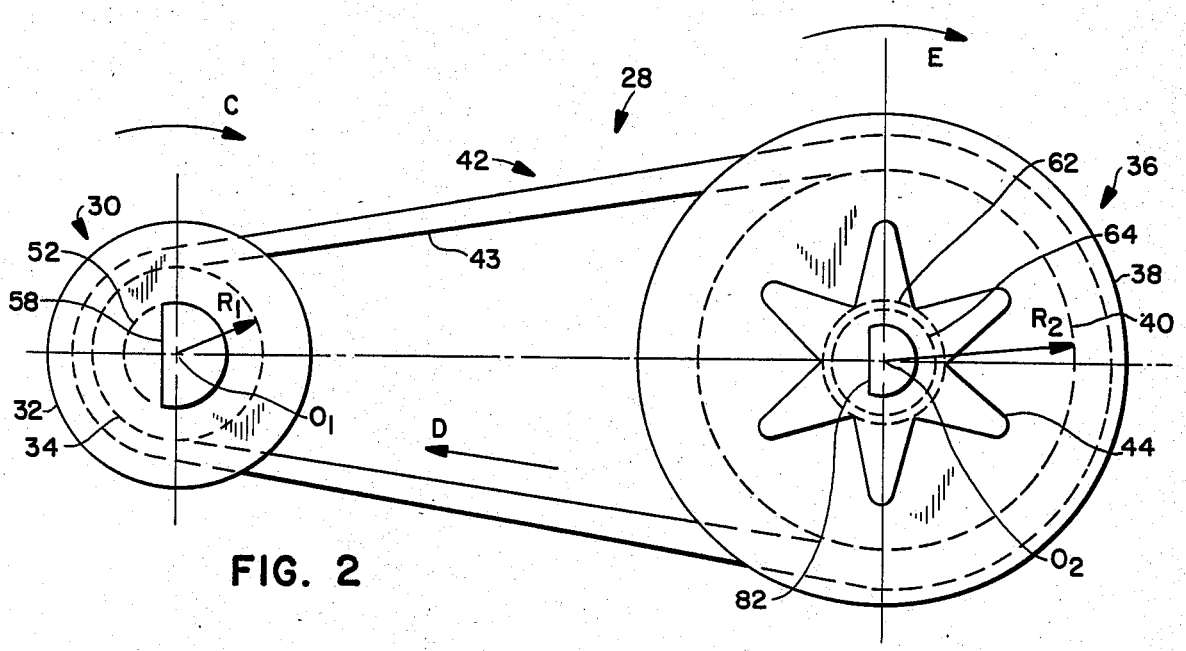
FIG. 2 is an illustration of a belt-type drive in accordance with the present invention.
Figure 3:
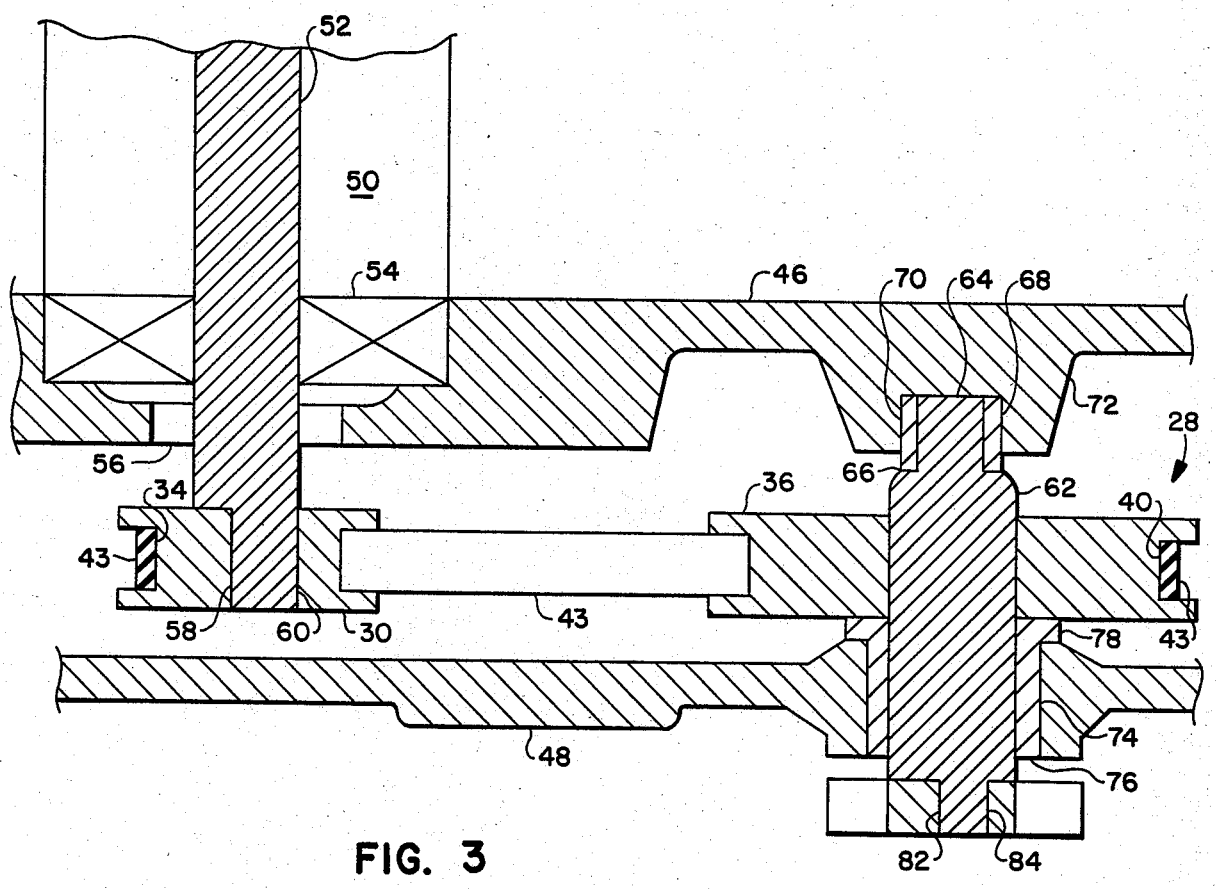
FIG. 3 is an illustration of a support system for a belt-type drive in accordance with the present invention.

Turning to FIGS. 2 and 3, a speed reduction mechanism according to the present invention is illustrated. FIG. 2 represents a belt-type drive 28 according to the present invention, while FIG. 3 represents a horizontal section of the belt-type drive 28 with additional detail as to the support structure for the belt-type drive 28.

As shown in FIG. 2, the belt-type drive 28 comprises: a first rotatable member 30 comprising a pulley 32 having a belt sheave 34 about its periphery, the belt sheave 34 having a radius $R_1$; a second rotatable member 36 comprising a pulley 38 having a belt sheave 40 about its periphery, the belt sheave 40 having a radius $R_2$; and an endless drive loop 42 comprising a belt 43 engagingly received by the belt sheaves 34 and 40.

The first rotatable member 30 rotates about its axis $O_1$ in the direction shown by the arrow "C". This drives the endless drive loop 42 in the direction shown by the arrow "D". The endless drive loop 42 in turn drives the second rotatable member 36 which rotates about its axis $O_2$ in the direction shown by the arrow "E". A drive sprocket 44 is connected to the second rotatable member 36 for rotation with the second rotatable member 36 in the same direction as the second rotatable member. As may be readily ascertained from FIG. 2, the first rotatable member 30 and the second rotatable member 36 (and hence the drive sprocket 44) rotate in the same direction. This assures that when the first rotatable member 30 is directly driven by the drive shaft of the motor, for rotation therewith, the drive sprocket 44 will rotate in the same direction as the motor. Thus, the rotational inertia of the motor will counterbalance any "kickback".

Speed reduction is obtained by varying the diameters of the belt sheaves in the mechanism. As shown, the radius $R_2$ of the belt sheave 40 of the second rotatable member 36 is greater than the radius $R_1$ of the belt sheave 34 of the first rotatable member 30, thus assuring a reduction in the rotational speed of the second rotatable member 36 with respect to the first rotatable member 30.

Turning now to FIG. 3, the endless drive loop 28 is shown in horizontal section with additional detail as to the support structure for the endless drive loop. The endless drive loop 28 is located between an inner portion 46 of the chain saw housing and an outer portion 48 of the chain saw housing. An electric motor 50 is mounted on the inner housing portion 46 by screws or bolts (not shown). The drive shaft 52 of the electric motor 50 is supported by motor bearing 54 (and other motor bearings not shown) and extends through an aperture 56 in the inner housing portion 46. The first rotatable member 30 is mounted on the drive shaft 52 for rotation therewith. Such mounting can be effected by providing a D-shaped spline 58 on the end of the drive shaft 52 which is received in a corresponding D-shaped aperture 60 in the first rotatable member 30. (Other mountings to achieve rotation of the gear with the shaft, as are known in the art, can also be utilized.) A belt sheave 34 is provided about the periphery of the first rotatable member 30 and drivingly engages belt 43. The second rotatable member 36 is fixedly attached to a rotatable shaft 62 for rotation therewith. The shaft 62 has an end portion 64 of reduced diameter, as compared to the shaft, which forms a shoulder 66 on the shaft. A bearing/bushing 68 is disposed about the reduced diameter end portion 64 in contact with the shoulder 66. The bearing/bushing 68 is received within a corresponding recess 70 in the adjacent wall portion 72 of the inner housing portion 46. The bearing/bushing 68 by contacting the shoulder 66 formed on the shaft 62 prevents lateral movement of the shaft toward the inner housing portion 46. The rotatable shaft 62 extends through an aperture 74 formed in the outer housing portion 48. A bearing 76 is provided within the aperture 74 to support the shaft 62. A flange portion 78 is provided on the bearing 76, this flange portion being disposed between and in contact with both the second rotatable member 36 and the adjacent wall portion 80 of the outer housing portion 48. Since the second rotatable member 36 is fixedly attached to the shaft 62, this flange portion 78 prevents lateral movement of the shaft 62 toward the outer housing portion 48. A belt sheave 40 is provided about the periphery of the second rotatable member 36 and drivingly engages belt 43. The end of the rotatable shaft 62 which extends through the aperture 74 is provided with a D-shaped spline 82 which is received in a corresponding D-shaped aperture 84 in the drive sprocket 44, whereby the drive sprocket 44 will rotate with the shaft 62. (Other mountings to achieve rotation of the sprocket with the shaft, as are known in the art, can also be utilized.)

Figure 4:
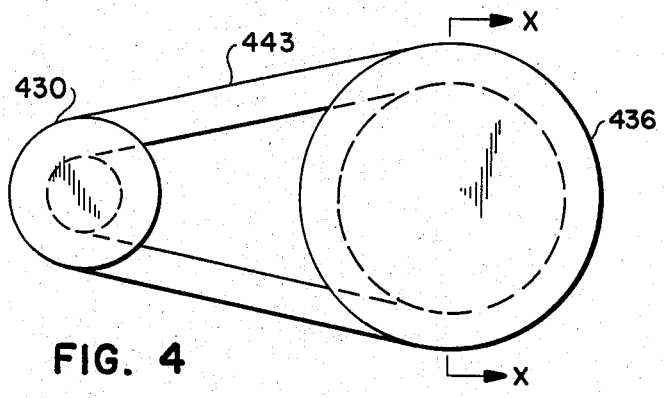
FIG. 4 is an illustration of a belt-type drive in accordance with the present invention.
Figure 5:
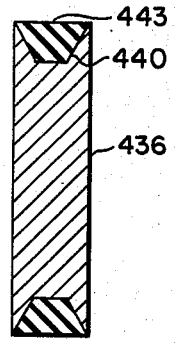
FIG. 5 is a sectional view along line X—X of FIG. 4.

FIGS. 4 and 5 illustrate a V-belt-type speed reduction mechanism for the present invention. A first rotatable member 430 and a second rotatable member 436 are each drivingly engaged by a V-belt 443. A belt sheave is provided about the periphery of each of the rotatable members 430 and 436, illustrated as 440 in FIG. 5 for the second rotatable member 436. The belt sheaves are of trapezoidal cross-sectional profile and receivably engage the belt 443 of corresponding cross-sectional profile.

Figure 6:
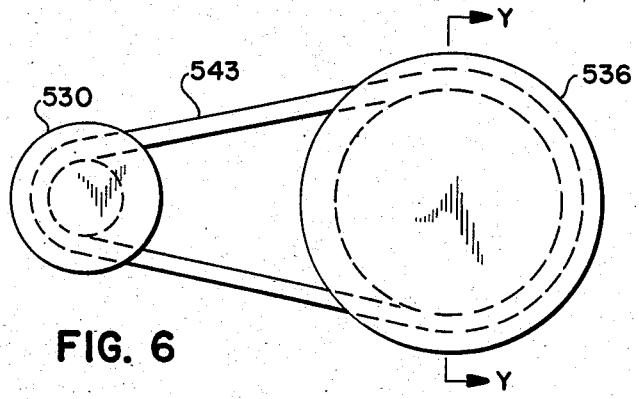
FIG. 6 is an illustration of another belt drive in accordance with the present invention.
Figure 7:
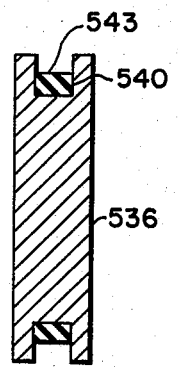
FIG. 7 is a sectional view along line Y—Y of FIG. 6.

FIGS. 6 and 7 illustrate a belt-type speed reduction mechanism for the present invention. A first rotatable member 530 and a second rotatable member 536 are each drivingly engaged by a belt 543. A belt sheave is provided about the periphery of each of the rotatable members 530 and 536, illustrated as 540 in FIG. 7 for the second rotatable member 536. The belt sheaves are of rectangular cross-sectional profile and receivably engage the belt 543 of corresponding cross-sectional profile. As illustrated, the belt sheave 540 is thicker than the corresponding belt 543, however, the belt can substantially fill the belt sheave so as to maximize frictional contact surface area between sheave and belt.

Figure 8:
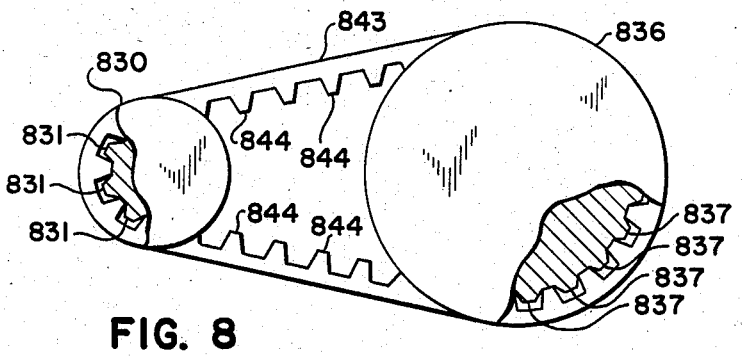
FIG. 8 is an illustration of a further belt-drive in accordance with the present invention.

FIG. 8 illustrates a timing belt-type speed reduction mechanism for the present invention. A first rotatable member 830 and a second rotatable member 836 are each drivingly engaged by a belt 843. A groove is provided about the periphery of each of the rotatable members 830 and 836 and teeth 831 and 837 are formed in the base of the groove, respectively, as shown in the cut-away sections. These teeth, 831 and 837, receivably engage corresponding teeth 844 formed on the belt 843.

Figure 9:
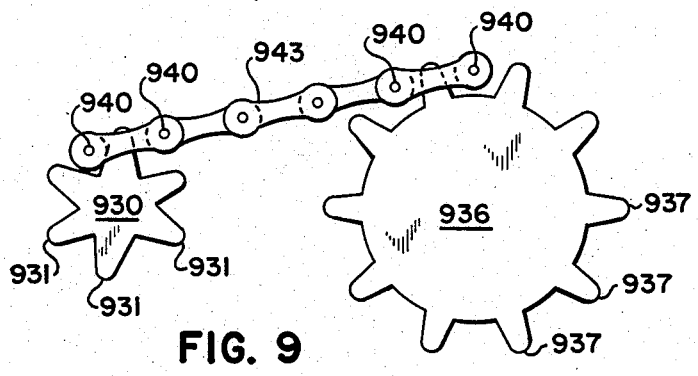
FIG. 9 is an illustration of a chain-type drive in accordance with the present invention.
Figure 10:
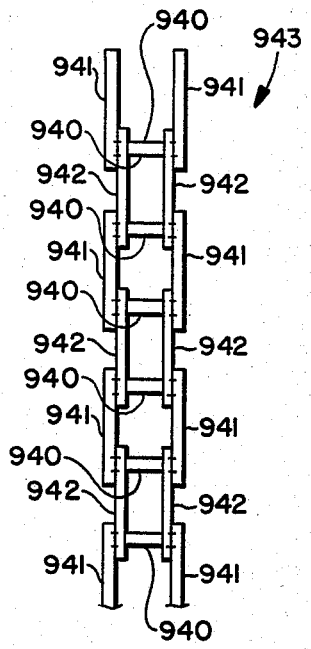
FIG. 10 is an illustration of a linked chain useable in the present invention.

FIG. 9 illustrates a chain drive speed reduction mechanism for the present invention. A first rotatable member 930 in the form of a sprocket having teeth 931 and a second rotatable member 936 also in the form of a sprocket having teeth 937 are each drivingly engaged by a linked chain 943. The teeth of the sprockets 931 and 937, respectively, engaging, the transverse connectors 940 of the linked chain (as best seen in FIG. 10). FIG. 10 illustrates a linked chain 943 useable in the embodiment of FIG. 9. The linked chain is formed of pairs of outboard link members 941 and pairs of inboard link members 942. Each link member, 941 and 942, has an aperture formed at each of its ends and these apertures receive transverse connectors 940. Each link member, 941 and 942, is pivotable about each transverse connector 940. Pairs of outboard link members 941 alternate with pairs of inboard link members 942, and adjacent pairs of link members are pivotally connected to one another by a common transverse connector 940.

Figure 11:
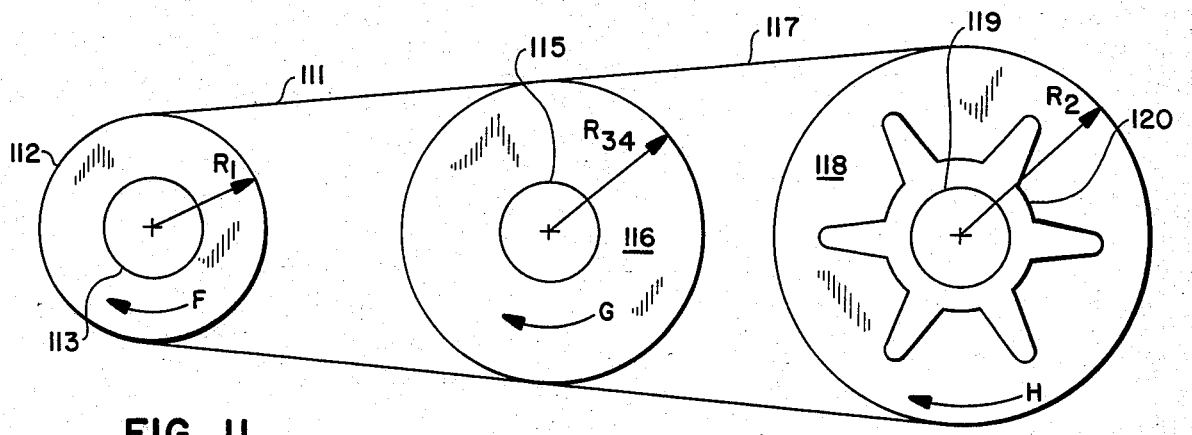
FIG. 11 is a frontal view of a dual drive in accordance with the present invention.
Figure 12:
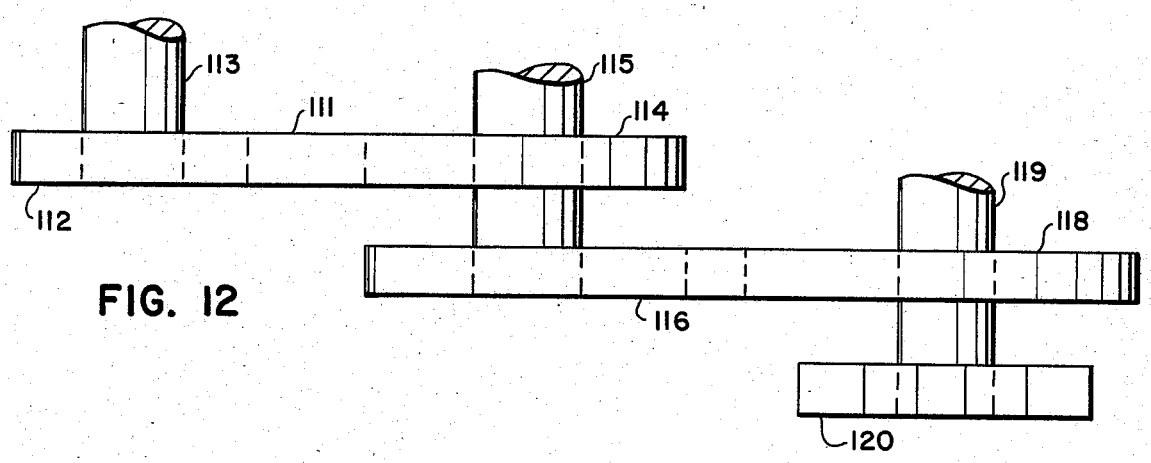
FIG. 12 is a top view of the drive depicted in FIG. 11.
Figure 13:
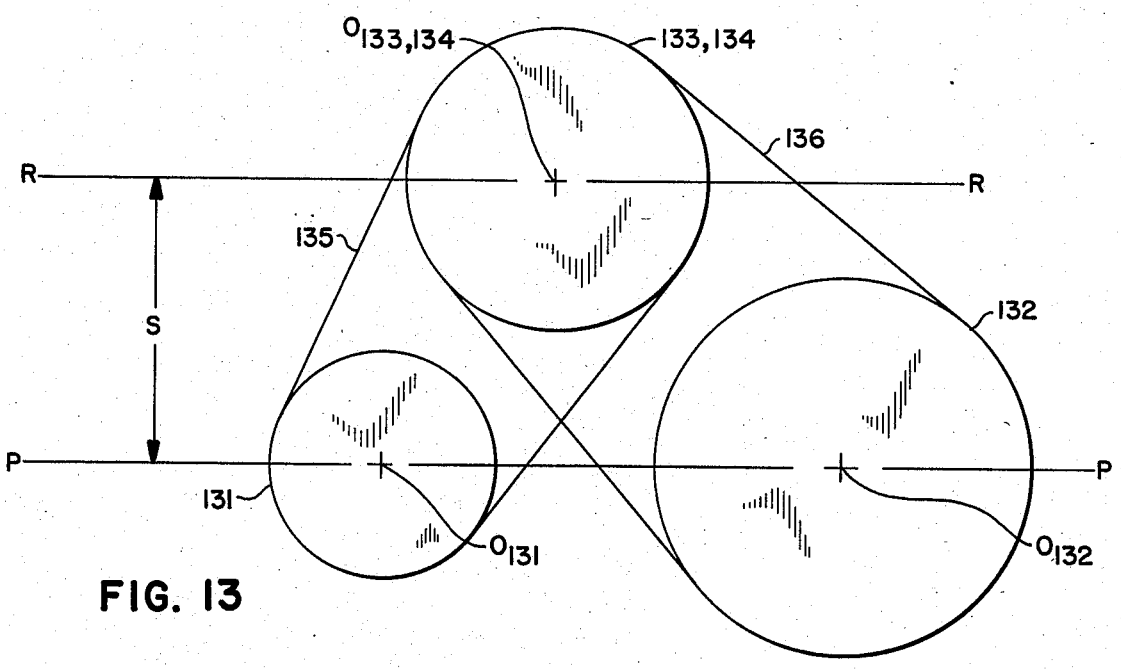
FIG. 13 is an illustration of a modified dual drive in accordance with the present invention.

FIGS. 11, 12 and 13 illustrate a dual drive speed reduction mechanism according to the present invention. (For ease of representation rotatable members have been illustrated as circles and endless drive loops (belts, chains, etc.) have been illustrated as lines.)

FIGS. 11 and 12 illustrate a dual drive wherein a first drive loop 111 drivingly connects a first rotatable member 112 mounted on the drive shaft 113 of an electric motor (not shown), for rotation therewith, with a third rotation member 114 mounted on a first shaft 115, for rotation therewith. A fourth rotational member 116 is mounted on the first shaft for rotation therewith. This fourth rotational member 116 is drivingly connected by a second drive loop 117 to a second rotational member 118 which is mounted on a second shaft 119 for rotation therewith. A drive sprocket 120 is mounted on the second shaft 119 for rotation therewith. When the drive shaft 113 (and hence the first rotatable member 112) is driven in the direction shown by the arrow "F", the third rotatable member 114 (and hence the first shaft 115 and the fourth rotatable member 116) will be driven in the direction shown by the arrow "G". In turn, the rotation of the fourth rotatable member 116 in the direction shown by the arrow "G" will drive the second rotatable member 118 (and hence the second shaft 119 and the drive sprocket 120) in the direction shown by the arrow "H". Thus, the drive shaft 113 and the drive sprocket 120 rotate in the same direction. It will be apparent to the skilled artisan, based on the above disclosure that additional drive loops and pairs of rotatable members mounted on common shafts for rotation therewith can be utilized to obtain the unidirectional rotation of the first rotatable member 112 and the second rotatable member 118. However, increasing the number of drive loops and rotatable members produces an increase in the size of the mechanism due to the need for additional support structures, shafts, bearings, etc.

Speed reduction is obtained by varying the diameter of rotatable members in the speed reduction mechanism. As shown in FIG. 11, the radius $R_2$ of the second rotatable member 118 is greater than the radius $R_1$ of the first rotatable member 112, thus assuring a reduction in the rotational speed of the second rotatable member 118 with respect to the first rotatable member 112. The interposition of the third and fourth rotatable members, 114 and 116, respectively, between the first and second rotatable members, 112 and 118, respectively, allows the speed reduction to take place in two stages. For this purpose, the third and fourth rotatable members 114 and 116, have identical radii, illustrated as $R_{34}$ in the Figure, which are less than the radius $R_2$ of the second rotatable member 118, but greater than the radius $R_1$ of the first rotatable member 112. Of course, a further reduction can be effected by making the radii of the third and fourth rotatable members 114 and 116, respectively, unequal, i.e. the radius of the third rotatable member 114 is greater than the radius of the fourth rotatable member 116.

FIG. 13 illustrates an alternative embodiment of the present invention wherein a size reduction in the speed reduction mechanism can be obtained. As shown in FIG. 13, a first rotatable member 131 is mounted for rotation about an axis $O_{131}$. A second rotatable member 132 is mounted for rotation about an axis $O_{132}$. Third and fourth rotatable members 133,134 are mounted for rotation in the same direction about a common axis $O_{133,134}$. The first rotatable member 131 and the third rotatable member 133 are drivingly connected by a first endless drive loop 135. The fourth rotatable member 134 and the second rotatable member 132 are drivingly connected by a second endless drive loop 136. The axes $O_{131}$, $O_{132}$ and $O_{133,134}$ are mutually parallel and, as depicted in the figure, extend out of the sheet of drawing perpendicular to the sheet. An imaginary line P—P connecting the axes $O_{131}$ and $O_{132}$ is shown, as is an imaginary line R—R passing through axis $O_{133,134}$, line R—R being parallel to line P—P. As may be seen, the axis $O_{133,134}$ is displaced a distance S from the imaginary line joining the other two axes. This displacement allows a more compact speed reduction mechanism to be obtained since the "outside" rotatable members, 131 and 132, may be drawn closer together. Further compaction of the speed reduction mechanism can be achieved by minimizing the size of the rotatable members while retaining the relative size of the rotatable members in the desired ratio for speed reduction.

The present invention has been illustrated with various belts, toothed belt and linked chain for the endless drive loop. The toothed belt and the linked chain cooperate with teeth on the rotatable members to desirably produce a positive engagement between endless drive loop and rotatable members. The belt members frictionally engage the rotatable members and can slip under heavy loads. However, such slippage can be useful in protecting the electric motor from overloading.

Figure 14:
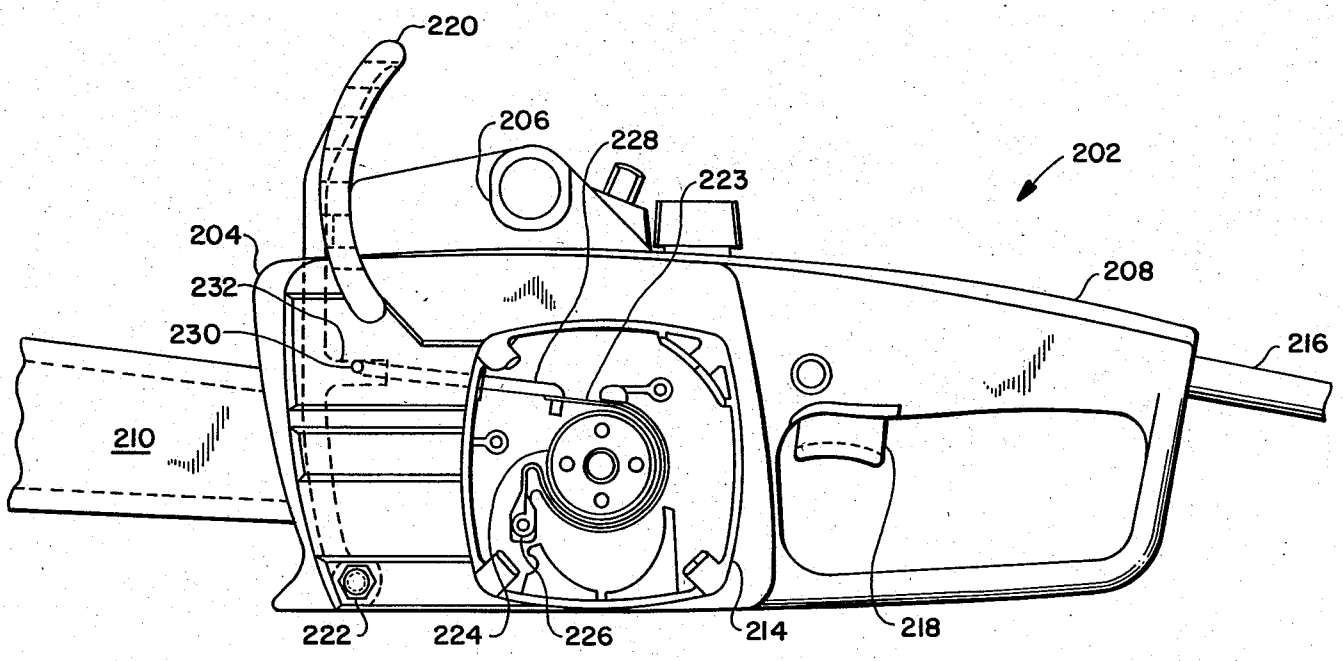
FIG. 14 is a partially cut away side view of an electric chain saw in accordance with the present invention illustrating the safety brake mechanism.

FIG. 14 illustrates a preferred embodiment of the chain saw safety braking mechanism for the present invention. As shown in FIG. 14, an electric chain saw, generally indicated at 202, is illustrated. The electric chain saw 202 has a housing 204 fitted with a front handle 206 and a rear handle 208. A guide bar 210 extends forwardly from the housing 204 and an endless cutter chain (not shown) extends around the guide bar 210 and is slidingly supported thereon for rotation thereabout. A drive sprocket (not shown) drivingly engages the endless cutter chain to rotate the cutter chain about the guide bar 210. An electric motor 214 provides the motive power to the drive sprocket through a speed reduction mechanism (not shown), whereby the drive sprocket, and hence the cutter chain, and the motor rotate in the same direction. The chain saw is fitted with a power supply cord 216 and a plug (not shown) for connection to an external electric power supply. A throttle switch 218 is provided on rear handle 208 for governing the speed of the electric motor 214.

The electric chain saw 202 is also fitted with a chain saw safety brake mechanism which will stop rotation of the cutter chain about the guide bar 210 when a "kick-back" occurs. In particular, a sensing arm 220 is disposed forward of the front handle 206 and between the front handle 206 and the guide bar 210. The sensing arm 210 is pivotally connected to the housing 204 at pivot 222, and can pivot forwardly from a first position ("brake off" position) to a second position ("brake on" position). The sensing arm 220 is yieldably urged (by spring biasing means not shown) to the first position, when in the first position, and to the second position, when in the second position. A flexible brake band 223 is disposed about a rotating member 224 of the electric motor 214. One end of the brake band is fixedly attached to the housing 204 as by a bolt 226. The other end of the brake band is attached to a link member 228, which in turn is pivotally connected at pivot 230, to a protuberance 232 on sensing arm 220. When the sensing arm 220 is in the first position ("brake off" position), the flexible brake band 223 will be held in spaced apart relation to the rotating member 224 of the electric motor 214. However, upon occurrence of a "kickback" and the consequent striking of the sensing arm 220 by the hand or arm of the operator, the sensing arm 220 will rotate forward to the second position ("brake on" position). In this second position, the flexible brake band 723 is drawn into frictional braking engagement with the rotating member 224 and rapidly stops the rotation thereof. It is this rapid stoppage of the rotation of the electric motor, transferring the rotational inertia of the motor to the saw, which allows the rotational intertia of the motor to counterbalance the "kickback" in accordance with the present invention wherein motor and cutter chain rotate in the same direction.

What is claimed is:

1. In an electric chain saw comprising a housing; a guide bar mounted on said housing; an endless cutter chain extending around said guide bar and slidingly supported thereon for rotation in a predetermined direction thereabout; a drive sprocket, rotatable about an axis, drivingly engaging said cutter chain; an electric motor, having a rotatable drive shaft, mounted within said housing; and a safety braking mechanism to stop the drive shaft from rotating upon occurrence of a kick-back; the improvement comprising:

speed reduction means for drivingly connecting said drive shaft and said drive sprocket for rotation in the same direction and reducing the rotational speed of said drive sprocket as compared to the rotational speed of said drive shaft, said speed reduction means comprising a first rotatable member of predetermined radius, rotatable about an axis, directly driven by said drive shaft for rotation therewith; a second rotatable member of predetermined radius, rotatable about an axis; first connecting means for coaxially connecting said second rotatable member and said drive sprocket for rotation in the same rotational direction about their common axis at the same rotational speed, said first connecting means comprising a first shaft, rotatable about an axis, said second rotatable member attached to said first shaft for rotation therewith, and said drive sprocket detachably connected to said first shaft for rotation therewith, said first shaft supported by a first bearing and a second bearing, said first bearing located between said drive sprocket and said second rotatable member, and said second bearing located on the opposite side of said second rotatable member from said first bearing; and endless drive loop means for drivingly connecting said first and second rotatable members for rotation of said first and second rotatable members in the same rotational direction as said cutter chain, said endless drive loop means comprising a single endless drive loop extending about said first and second rotatable members, said drive loop drivingly engaging said first and second rotatable members, whereby the rotational inertia of said electric motor opposes kickback of said chain saw.

2. The electric chain saw as claimed in claim 1, wherein said first rotatable member is detachably mounted on said drive shaft for rotation therewith.

3. The electric chain saw as claimed in claim 1, wherein said second rotatable member is of a radius greater than the radius of said first rotatable member.

4. The electric chain saw as claimed in claim 1, wherein said first and second rotatable members each comprise a pulley having a belt sheave of predetermined cross-sectional profile about the periphery thereof, and said endless drive loop comprises a belt of predetermined cross-sectional profile receivingly engageable within said belt sheave.

5. The electric chain saw as claimed in claim 4, wherein said belt sheave is of rectangular cross-section.

6. The electric chain saw as claimed in claim 1, wherein said belt sheave is of trapezoidal cross-section.

7. The electric chain saw as claimed in claim 1, wherein said first and second rotatable members each comprise an externally toothed gear, and said endless drive loop comprises a toothed belt, the teeth of said belt receivingly engageable between the teeth of said gears.

8. The electric chain saw as claimed in claim 1, wherein said first and second rotatable members each comprise a toothed sprocket wheel, and said endless drive loop comprises a linked chain, said linked chain receivingly engageable of said sprocket teeth.

* * * * *